United States Patent [19]

Clarke et al.

[11] Patent Number: 4,506,536

[45] Date of Patent: Mar. 26, 1985

[54] JAW ASSEMBLY FOR BLIND RIVETING

[75] Inventors: Ronald L. C. Clarke; Donald S. Savage, both of St. Albans, England

[73] Assignee: Avdel Limited, Hertfordshire, England

[21] Appl. No.: 505,499

[22] Filed: Jun. 17, 1983

[30] Foreign Application Priority Data

Jul. 2, 1982 [GB] United Kingdom ..... 8219284

[51] Int. Cl.[3] ..... B21P 9/05

[52] U.S. Cl. ..... 72/391; 269/217

[58] Field of Search ..... 72/391, 390, 453.17, 72/114, 460; 29/243.53; 269/254, 238, 234, 217, 901, 39; 294/86.3, 86.31

[56] References Cited

U.S. PATENT DOCUMENTS 4,059,981 11/1977 Holloway ..... 72/453.17
4,065,952 1/1978 Holloway ..... 72/391
4,220,033 9/1980 Powderley ..... 72/391
4,322,065 3/1982 Doiron ..... 269/254 R

FOREIGN PATENT DOCUMENTS 1572269 7/1980 United Kingdom .

*Primary Examiner*—Daniel C. Crane
*Assistant Examiner*—David B. Jones
*Attorney, Agent, or Firm*—Oblon, Fisher, Spivak, McClelland & Maier

[57] ABSTRACT

A blind riveting tool has a front abutment provided by a pair of jaws which are spring-urged into their closed position and move to their open position by a generally pivoting movement of each jaws. The jaws are opened by means of a ball which is in contact with the outside of the rearward end of each jaw, the balls being encircled by a rotatable ring having cam faces in contact with the balls. When the ring is rotated, the cam faces force the balls inwards to press the rearward ends of the jaws together, thereby to make each jaw pivot and open the front end of the jaws.

8 Claims, 5 Drawing Figures

Figure 2:
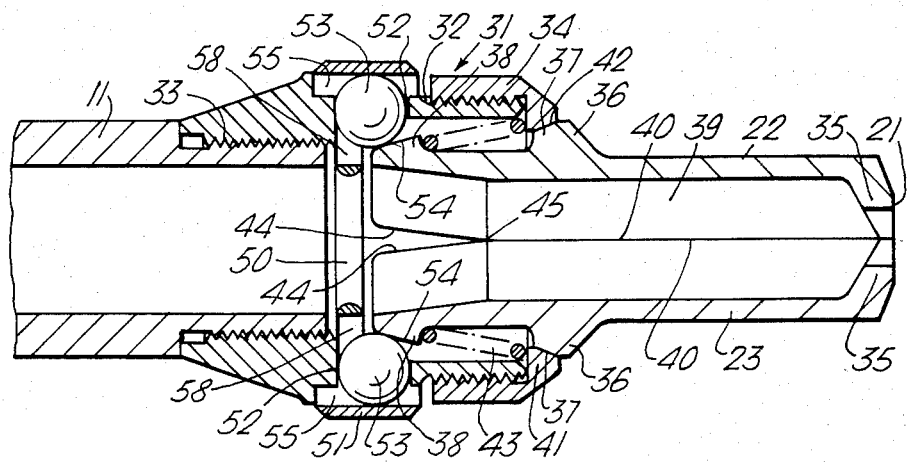

Fig. 1.
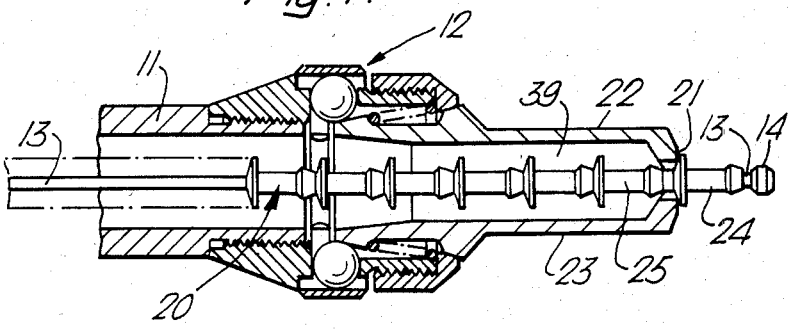
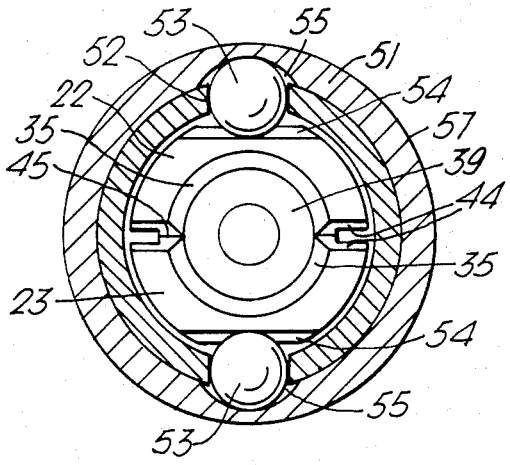
Fig. 4.
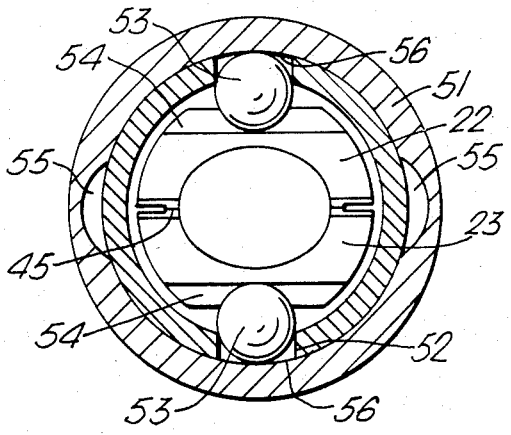
Fig. 5.

JAW ASSEMBLY FOR BLIND RIVETING

The invention relates to a jaw assembly for blind riveting of the type comprises a plurality of jaws movable between an open position in which the jaws allow the passage therethrough of a rivet, and a closed position in which the jaws form an abutment to support the rivet during placing thereof.

Although in use the jaws do not actually grip anything, they are commonly referred to in the art as "jaws" since their repeated opening and closing action is analagous to that of, for example, the jaws of a pair of pliers. In their closed position the jaws form an abutment to support the rivet against a pull applied to it by means of a mandrel or stem which passes through the closed jaws without being gripped by them.

There are two alternative main systems of blind riveting using such rivets and jaw assemblies. In the so-called "pull-through" system a single elongated mandrel has a number of tubular rivets loaded on it, the head of the mandrel being pulled through each rivet in turn to place it, a further rivet being fed forwards through the jaws when the mandrel moves forwards again. Commonly the jaws are spring-urged towards their closed position, are pushed open by the rivet being fed through them and close together again behind the rivet under the urging of the spring. However in order to reload the mandrel with a further supply of rivets it is necessary first to remove the empty mandrel and then to re-insert the reloaded mandrel through the jaws, which necessitates opening the jaws from the front or outside.

In the so called "breakstem" blind riveting system the rivets are provided in the form of rivet assemblies each comprising a rivet and a breakstem mandrel assembled together. In this case complete rivet assemblies are fed successively through the jaws, the requisite opening of the jaws being effected either by pressure from the rivet assembly, or by separate jaw-opening means acting on the jaws. Furthermore it is necessary to arrange that the jaws can be opened when required for inspection and maintenance purposes.

The invention provides a jaw assembly for blind riveting comprising:

- a housing through which rivets to be placed are fed successively to a plurality of jaws carried by the housing, the jaws being movable between an open position in which they allow the passage therethrough of a rivet and a closed position to which their forward ends form an abutment to support the rivet during placing thereof, by a generally pivoting movement of each jaw about a position intermediate its forward end and rearward end;
- and jaw opening means operable to move the jaws from their closed position to their open position, the jaw-opening means comprising:
- a rotatable member which is rotatable about the housing and around the path along which the rivets are fed;
- and a movement-transmission member interposed between the rotatable member and the rearward part of each jaw member;
- rotation of the rotatable means causing movement of each movement-transmission member inwardly so as to press radially inwardly on the rearward part of the associated jaw and cause the jaw to pivot as aforesaid from its closed to its open position.

Preferably each movement-transmission member is received in an aperture in the housing.

Preferably each movement-transmission member is provided by a spherical ball.

Preferably the rotatable member may be moved to cause opening of the jaws as aforesaid by rotation in either sense about the housing.

Preferably the rotatable member may be moved to allow closing of the jaws from their open position by rotation of the rotatable member in either sense about the housing.

Figure 3:
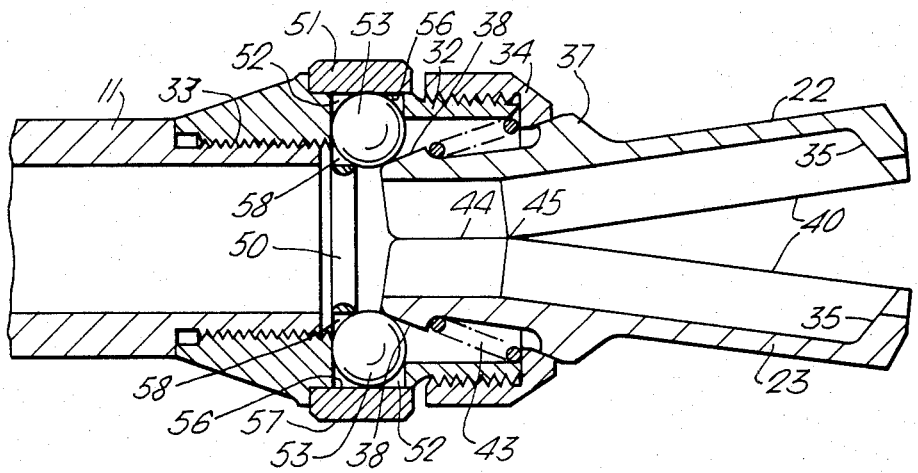

A specific embodiment of the invention will now be described by way of example and with reference to the accompanying drawings, in which:

FIG. 1 is a longitudinal axial section through part of a pull-through blind riveting gun loaded with rivets including a jaw assembly according to the present invention;

FIGS. 2 and 3 are longitudinal axial sections, on an enlarged scale, through the jaw assembly in the closed and open positions respectively; and FIGS. 4 and 5 are cross-sections on the line A—A of FIGS. 2 and 3 respectively.

The riveting apparatus of which part is illustrated in FIG. 1 is a pneumatically operated hand-held blind riveting gun of the kind used in pull-through blind riveting systems commercially available under the Registered Trade Mark "CHOBERT" and "BRIV". It comprises an elongated barrel 11 on the front end of which is mounted the jaw assembly 12. Throughout the length of the barrel extends a steel mandrel 13 having an enlarged head 14. The mandrel carries a stack of tubular rivets 20 preloaded on it. The rear or tail end of the mandrel is releasably clamped in tail jaws (not shown) which are reciprocable longitudinally of the barrel with respect thereto by means of a triple piston and cylinder device. This is actuated by means of a valve operated by a trigger button and connected to an air line. In the normal or forward position of the mandrel, as shown in FIG. 1, the mandrel head 14 is sufficiently far in front of the abutment face 21 of the nose jaws 22, 23 of the jaw assembly 12 to accommodate the leading rivet 24 between the abutment 21 and mandrel head 14. When the trigger is pressed by the gun operator, the valve admits compressed air to the piston and cylinder device. This retracts the mandrel head 14 through the tubular rivet 24, thus broaching or placing the rivet. The rivet is prevented from moving rearwardly by the support of the abutment face 21 against the head of the rivet. When the trigger is released, the mandrel returns forwardly to its original position, under the urging of a spring (not shown). As it does so, the next rivet 25 is pushed through the jaws 22, 23 which open temporarily to allow its passage. The rivet is pushed forwards by the action of a so-called cursor at the rear of the stack of rivets 20, the cursor being operated either mechanically by the reciprocation of the mandrel and barrel, or pneumatically. The jaws 22, 23 close behind the rivet after the latter has passed through them, ready for the next cycle of operation of the tool to broach the next rivet.

The jaw assembly is shown in greater detail in FIGS. 2 and 3. It comprises a tubular housing 31 and the two jaws 22, 23. The housing consists of a main body 32, the rear end 33 of which is screwed on to the front end of the barrel 11, and a retaining cap 34 which is screwed over the forward end of the body 32. Each jaw 22, 23 is generally half-tubular and is formed at its forward end with an internal lip 35, the forward face of which provides half of the jaw abutment face 21. Intermediate its length the jaw is formed with a shaped external projection 36, the rearward part 37 of which tapers inwardly and rearwardly. At its inner end the jaw is formed with an external flange 38. The jaw 23 is a mirror image of the jaw 22, and the jaws present between them a cylindrical passage 39 of such a diameter that the enlarged heads of the rivets 20 can easily pass through. At the forward end the bore 30 between the lips 35 is constricted in diameter so that the front abutment face 21 supports a rivet head as previously described. The rear faces of the lips 35 are inclined to facilitate the advancing head of a rivet pushing the jaws apart.

The rearward part of the jaws are located inside the housing 32. The forward end of the housing, on the front of the cap 34, has an inwardly extending flange 41 formed with an outwardly opening internal taper 42 which matched the rearward tapers 37 on the jaw projections 36. A coiled part-conical compression spring 43 is located inside the forward part of the jaw housing 32 and around the rearward part of the jaws. The spring abuts at its rear, narrower, end against the rear end flanges 38 on the jaws and at its forward, wider, end against the front flange 41 on the housing. Consequently the spring 43 urges the jaws 22, 23 rearwardly into the housing. The action of the front housing flange taper 42 on the tapered parts 37 on the jaw projections urges the jaws towards each other and into contact, i.e. into the closed position.

Each jaw has an inner face which contacts the other jaw. Each inner face comprises a forward part 40 which when the jaws are closed lies substantially along the mandrel axis (i.e. in a plane containing the mandrel axis) and a rearward part 44 which, when the jaws are in a closed position diverges rearwardly away from the mandrel axis. The junction between the two inner face parts 40, 44 is at an apex 45.

When an advancing rivet is pushed through the jaws from the back to the front of the lips 35, the housing taper 42 constrains the jaws so that they must move slightly forwardly, compressing spring 43 slightly, in order that the front ends of the jaws can move apart to allow the rivet head to pass. Each jaw also rocks or rolls with a generally pivoting action about the apex 45, so that the rear inner face parts 44 move slightly together, (but not as much as shown in FIG. 3). After the rivet head has passed through the lips 35, the spring 43 closes the jaws behind it.

Thus far the action of the jaw assembly is conventional and well known.

When all the stack of rivets 20 preloaded on the mandrel 13 have been placed, the mandrel must be removed from the gun, reloaded with another stack of rivets, and replaced in the gun. The tail jaws are readily unlocked (and re-locked) by means which are well known and form no part of the present invention. Since the mandrel head 14 protrudes beyond the front of the jaws 22, 23 (see FIG. 1) it is easily grapsed and the mandrel removed from the gun. However, in order to replace the reloaded mandrel in the gun it is necessary to open the jaws 22, 23 sufficiently wide to allow the enlarged rivet heads to pass freely between the lips 35. This opening of the jaws has previously been achieved by the operator by grasping the jaws and pulling them forwards and apart, whilst at the same time holding the reloaded mandrel in one hand and preventing the stack of rivets from sliding off of it. This can be very difficult and requires considerable experience to carry out successfully. It has also been proposed to open the jaws by squeezing their rear ends together. However, this still requires pressure on the jaw rear ends to be maintained to keep the jaws open.

Referring now to FIGS. 2 to 5, the jaw-opening means of this example comprises a ring 51 mounted on the housing 32 and bridging the rear part 33 and forward part 32 thereof. The ring surrounds the housing and overlies two diametrically-opposed circular apertures 52 in the housing, the apertures being positioned on a diameter of the housing at right-angles to the plane occupied by the inner faces 43 of the jaws. Each aperture 52 receives a spherical steel ball 53, the inner side of which contacts the rear end of the associated jaw at a flat face 54 just behind the flange 38. The action of the spring 43 in urging the rear ends of the jaws apart also urges the balls 53 radially outwardly of the housing and into contact with the inside of ring 51. The ring is retained on the housing between the rear end of retaining cap 34 and a flange on the rear part 33 of the housing. As best seen in FIGS. 4 and 5, this inner face of the ring is mostly cylindrical as at 56, except for two opposed recesses 55. When ring 51 is in such a rotational position that the recesses 55 are opposite the apertures 52, the balls 53 move outwardly into the recesses and allow the jaws 22, 23 to close, as shown in FIGS. 2 and 4. When the operator rotates the ring 51 in either sense about the housing axis, the sloping ends of the recesses 55 act as cam faces and force the balls radially inwardly, thus forcing the rear ends of the jaws towards each other. The jaws rock or roll in generally pivoting movements about the positions 45 as well as sliding slightly forwards, until the rearward parts 44 of the inner faces are in contact. This opens the front lips 35 of the jaws wide apart, as illustrated in FIG. 3. This makes very easy the removal of the empty mandrel and the insertion of the reloaded mandrel 13 and rivets 20 between the jaws. The balls 53 are prevented from dropping off the inner ends of the jaws by means of a retaining ring 50 which has two recesses 58 in which the balls 53 are retained.

As long as the balls 53 are riding on the ring faces 56 the jaws will stay open, even if the operator lets go of the ring 51. He can thus give his full attention to reloading the gun. When the ring 51 is returned to the "closed" position (by rotation in either sense) the detent action of the balls 53 in the recesses 55 prevent rotation of the ring to the "open" position without deliberate action on the part of the operator. The outside peripheral face 57 of the ring is knurled to help the operator grip it and turn it. When the ring is in the "closed" position, of course the jaws are only closed under the biassing of spring 43 and may still be opened by rivets fed through them, as previously described.

The invention is not restricted to the details of the foregoing example. For instance, the rotatable member need not necessarily be a complete ring. The part of the rotable member accessible to the operator need not be the complete ring, but could be one or more projecting knobs or levers.

The invention may be applied to blind riveting tools of the "breakstem" type, as previously described, to provide for opening the jaws of such tools.

We claim:

1. A jaw assembly for blind riveting comprising:

a housing through which rivets to be placed are fed successively to a plurality of jaws carried by the housing, the jaws being movable between an open position in which the jaws allow the passage therethrough of a rivet and a closed position in which forward ends of said jaws form an abutment to support the rivet during placing thereof, by a generally pivoting movement of each jaw about a position intermediate said forward end and a rearward end thereof;

and jaw opening means operable to move the jaws from said closed position to said open position, the jaw-opening means comprising:

a rotatable member which is rotatable about the housing and around a path along which the rivets are fed;

and a movement-transmission member interposed between the rotatable member and the rearward part of each jaw member, means associated with said rotatable member and each said movement-transmission member for moving each said movement-transmission member inwardly upon rotation of said rotatable member so as to press each said movement-transmission member radially inwardly on the rearward part of the associated jaw and cause the jaw to pivot from said closed to said open position.

2. A jaw assembly as claimed in claim 1, in which each movement-transmission member is received in an aperture in the housing.

3. A jaw assembly as claimed in claim 1 or claim 2, in which each movement-transmission member comprises a spherical ball.

4. A jaw assembly as claimed in claim 1, wherein said means for moving are constructed such that rotation of said rotatable member in either directional sense will cause said opening of the jaws.

5. A jaw assembly as claimed in claim 1, wherein said means for moving are constructed such that rotation of said rotatable member in either directional sense will allow closing of the jaws from said open position.

6. The jaw assembly of claim 1, wherein said means for moving comprise an inner cylindrical surface of said rotatable member and a recess in said cylindrical surface for each said movement-transmission member, wherein each said movement-transmission member is receivable in a corresponding said recess only at a predetermined angular position of said rotatable member to open each said jaw.

7. The jaw assembly of claim 3, wherein said means for moving comprise an inner cylindrical surface of said rotatable member and a recess in said cylindrical surface for each said spherical ball, wherein each said spherical ball is receivable in a corresponding said recess only at a predetermined angular position of said rotatable member.

8. The jaw assembly of claim 7, wherein said rotatable member is a ring.

* * * * *